US010787357B2

(12) United States Patent
Giarratano et al.

(10) Patent No.: US 10,787,357 B2
(45) Date of Patent: Sep. 29, 2020

(54) MOBILE BEER-DISPENSING SYSTEM

(71) Applicant: Coors Brewing Company, Denver, CO (US)

(72) Inventors: Cecil E. Giarratano, Lakewood, CO (US); Jason M. Kelly, Arvada, CO (US)

(73) Assignee: Coors Brewing Company, Denver, CO (US)

( * ) Notice: Subject to any disclaimer, the term of this patent is extended or adjusted under 35 U.S.C. 154(b) by 91 days.

(21) Appl. No.: 16/102,948

(22) Filed: Aug. 14, 2018

(65) Prior Publication Data

US 2019/0047839 A1 Feb. 14, 2019

Related U.S. Application Data

(60) Provisional application No. 62/545,320, filed on Aug. 14, 2017.

(51) Int. Cl.

| | |
|---|---|
| ***B67D 1/08*** | (2006.01) |
| *B67D 1/16* | (2006.01) |
| *B67D 1/12* | (2006.01) |
| *B67D 1/04* | (2006.01) |

(52) U.S. Cl.

CPC ..... *B67D 1/0857* (2013.01); *B67D 1/0462* (2013.01); *B67D 1/0801* (2013.01); *B67D 1/0844* (2013.01); *B67D 1/0861* (2013.01); *B67D 1/0867* (2013.01); *B67D 1/0869* (2013.01); *B67D 1/0872* (2013.01); *B67D 1/12* (2013.01); *B67D 1/1252* (2013.01); *B67D 1/16* (2013.01); *B67D 2210/00133* (2013.01)

(58) Field of Classification Search

CPC ... B67D 1/0857; B67D 1/0867; B67D 1/0801

See application file for complete search history.

(56) References Cited

U.S. PATENT DOCUMENTS

| | | | | |
|---|---|---|---|---|
| 2,446,895 | A * | 8/1948 | Weiss | F25D 31/002 62/224 |
| 3,232,489 | A * | 2/1966 | Buffington | B67D 1/06 222/108 |
| 3,312,083 | A * | 4/1967 | Scoggins | B67D 1/0857 62/390 |
| 3,790,039 | A * | 2/1974 | Zucconi | B67D 1/0829 222/394 |
| 5,303,845 | A * | 4/1994 | Osawa | B67D 1/1252 222/1 |
| 7,810,679 | B2 * | 10/2010 | Wauters | B67D 1/0462 222/105 |
| 9,162,863 | B2 * | 10/2015 | Till | B67D 1/0884 |
| 9,914,630 | B2 * | 3/2018 | Takei | B67D 1/04 |

* cited by examiner

*Primary Examiner* — Frantz F Jules
*Assistant Examiner* — Lionel Nouketcha
(74) *Attorney, Agent, or Firm* — Sheridan Ross P.C.

(57) ABSTRACT

Methods and systems of a mobile beer-dispensing system are provided. The system includes a mobile cart, a beer storage tank or container mounted to the mobile cart, a pressurization system configured to selectively force beer from the storage tank, a beer-dispensing tap, a fluid transport line configured to convey the beer from the storage tank to the tap, and an integrated cooling system that keeps the storage tank and the fluid transport lines cool.

20 Claims, 4 Drawing Sheets

MOBILE BEER-DISPENSING SYSTEM

CROSS REFERENCE TO RELATED APPLICATION

The present application claims the benefit of and priority, under 35 U.S.C. § 119(e), to U.S. Provisional Application Ser. No. 62/545,320, filed Aug. 14, 2017, entitled "Mobile Beer-Dispensing System," the entire disclosure of which is hereby incorporated herein by reference, in its entirety, for all that it teaches and for all purposes.

FIELD

The present disclosure is generally directed to fluid dispensing system, in particular, toward a mobile cooled and pressurized fluid dispensing system.

BACKGROUND

Unlike many canned and bottled beverages, beer has a relatively short shelf life. While environmentally-controlled beer can last several months on the shelf, the taste of beer is best when consumed within the shortest time of being brewed. Among other things, the freshness and taste of beer relies on maintaining a controlled environment for the beer during packaging, transportation/distribution, and dispensing.

Beer can be stored and transported in cans, bottles, kegs, and/or other containers. Kegs are typically employed to transport beer to bars, tap houses, and/or other businesses that dispense draft beer. Although a brewer can control the environment (e.g., light, temperatures, gas, etc.) of beer transported in kegs, the brewer cannot guarantee freshness and taste of the beer after the keg is interconnected with a business's draft dispensing system (e.g., short draw, long draw, or other dispensing system.

For instance, many commercial beer-dispensing systems are not maintained, cleaned, or otherwise purged between taps. In this case, when a new keg is interconnected with the unmaintained beer-dispensing system old/stale beer, bacteria, and/or other unwanted substances may mix with the beer dispensed from the keg and the quality and taste of the beer can suffer.

DETAILED DESCRIPTION

It is with respect to the above issues and other problems that the embodiments presented herein were contemplated. Embodiments of the present disclosure will be described in connection with a mobile beer-dispensing system. In general, embodiments of the present disclosure provide methods, devices, compounds, and systems that provide an integrated mobile beer storage and dispensing platform. In some embodiments, the mobile beer-dispensing system includes a mobile cart, a beer storage tank or container mounted to the mobile cart, a pressurization system configured to selectively force beer from the storage tank, a beer-dispensing tap, a fluid transport line configured to convey the beer from the storage tank to the tap, and an integrated cooling system that keeps the storage tank and the fluid transport lines cool. The mobile beer-dispensing system is not interconnected with foreign fluid distribution lines or tap systems, and as such, the quality of the product dispensed from the mobile system can be guaranteed.

Figure 1:
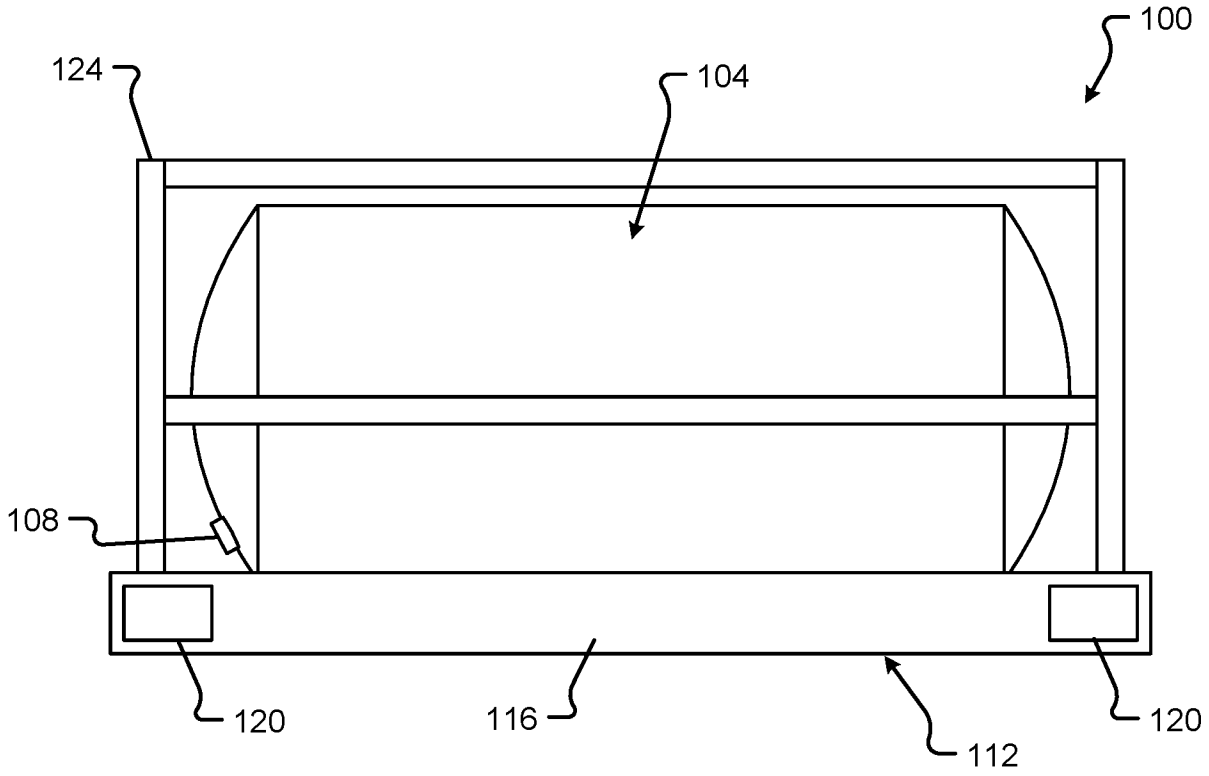
FIG. 1 shows a beverage storage system in accordance with embodiments of the present disclosure.

FIG. 1 shows a beverage storage system 100 in accordance with embodiments of the present disclosure. In general, the beverage storage system 100 may include a fluid storage tank 104, a fluid port 108, and a frame 112 to which the beverage storage system 100 is connected. The frame 112 may comprise a base 116, side and end lift receptacles 120, and a guard assembly 124 comprising one or more uprights, crossbars, and/or other structural elements.

The fluid storage tank 104 may be a pressure vessel, or other container, configured to store fluid (e.g., a beverage or liquid such as beer, etc.) therein. In some embodiments, the fluid may be held in a bag, or flexible bladder, disposed inside the fluid storage tank 104 and fluidly interconnected with the fluid port 108. In this example, the fluid storage tank 104 may provide sufficient structure around the bladder to protect the bladder and fluid during shipment, hold a positive or negative pressure, and/or thermally, or otherwise, insulate the fluid inside the bladder from the environment outside of the fluid storage tank 104.

In one embodiment, the fluid storage tank 104 may be selectively pressurized to control a release of the fluid from the bladder through the fluid port 108. For instance, to release fluid from the system 100, the space inside the fluid storage tank 104 (e.g., the space between the inner walls of the tank 104 and the outside surface of the bladder) may be pressurized exerting a pressure on the bladder and the contents inside the bladder. Once the port 108 is opened (e.g., via a valve) the contents inside the bladder may be expelled through the port 108. As the fluid escapes the bladder, while under pressure, the bladder may collapse inside the fluid storage tank 104. Among other things, this arrangement provides a clean, safe, and reliable storage of fluid inside the fluid storage tank 104.

The fluid storage tank 104 may be mounted to a frame 112 for storage, transport, and/or protection. The tank 104 may be fastened to the frame 112 via one or more clamps, straps, and/or other supports. In some cases, the tank 104 may be mounted to the frame 112 via one or more isolation mounts. The isolation mounts may mechanically isolate the tank 104 from the frame 112. Mechanical isolation may include thermal and/or shock isolation. For example, any force or impact imparted on the frame 112 may be at least partially prevented from passing through to the tank 104. As another example, the tank 104 may be athermalized, or thermally isolated, from the frame 112 at the isolation mounts. In this example, the isolation mounts may include a thermal insulation layer or interruption in a thermal path between the tank 104 and the frame 112.

The frame 112 may comprise a metal, plastic, or composite shroud that is configured to protect the tank 104. In one embodiment, the frame 112 may be manufactured from welded metal (e.g., aluminum, steel, titanium, etc.) and comprise a base 116 and a guard assembly 124. The base 116 may be made from welded structural tubing and include one or more lift points or receptacles 120. The lift receptacles 120 may be configured to receive one or more forks from a fork lift, such that the system 100 may be lifted, moved, and/or transported without contacting the tank 104. The guard assembly 124 may comprise one or more rails, crossbars, uprights, and/or frame elements that are interconnected to one another. In some embodiments, the guard assembly 124 may be welded, bent, and/or formed. The guard assembly 124 may be configured to extend beyond the bounds of, or envelope, the tank 104. The guard assembly 124 may provide a structural exoskeleton configured to prevent protect the tank 104 from incidental contact, damage, and/or other impact. In some cases, the guard assembly 124 may provide mount points for advertising, trademarks, and/or other graphics.

The beverage storage system 100 and/or the fluid storage tank 104 may correspond to a Transport Tank, Event Tank, Beer Tank, or other "bag-in-tank" beer system or component sold and/or manufactured by Paul Mueller Company, Duotank, Nittel, etc.

Figure 2:
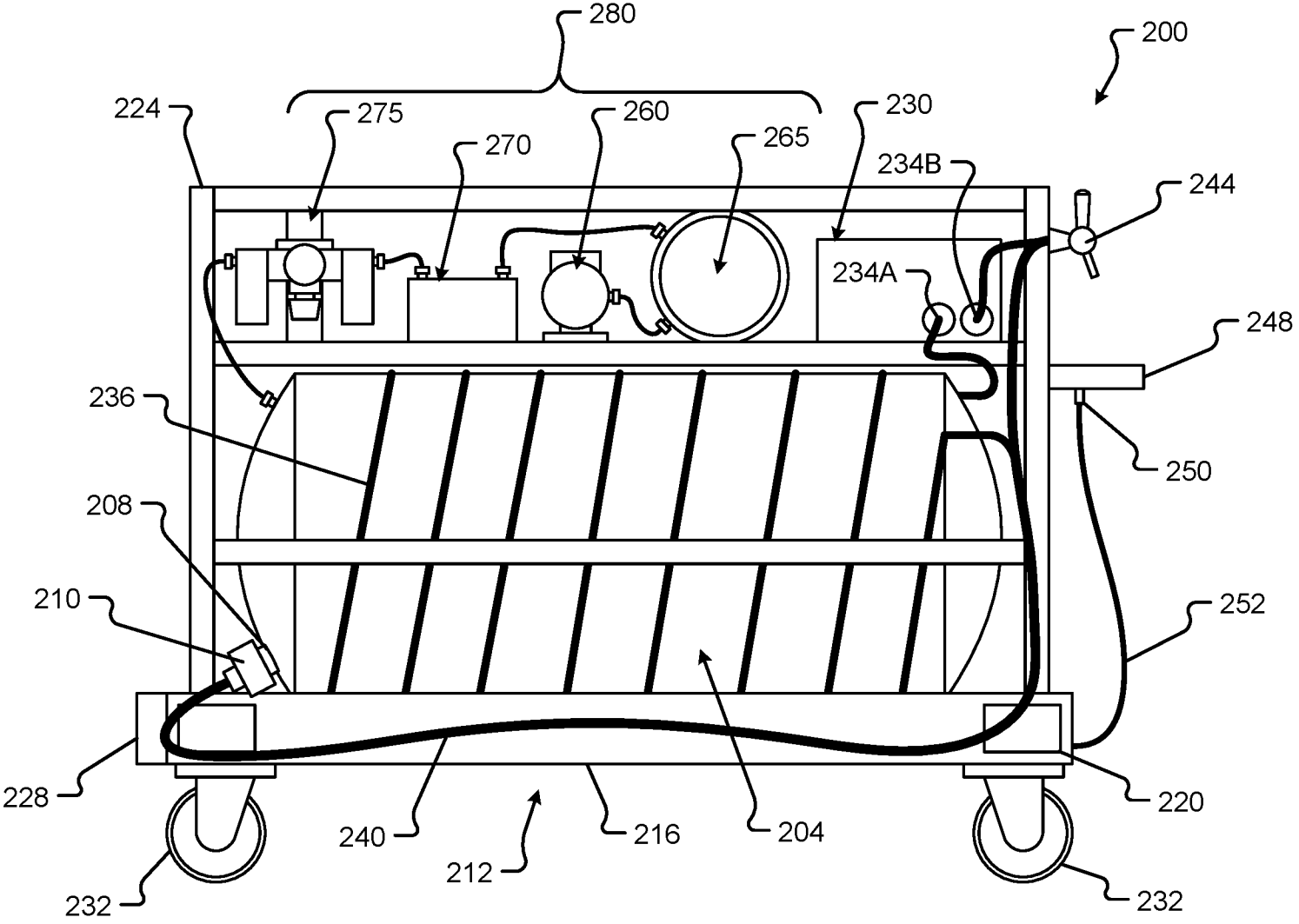
FIG. 2 shows a mobile beer-dispensing system in accordance with embodiments of the present disclosure.

FIG. 2 shows an elevation view of a mobile beer-dispensing system 200 in accordance with embodiments of the present disclosure. The mobile beer-dispensing system 200 may include at least one tank 204, a frame 212, at least one fluid distribution line 240, at least one dispensing tap 244, at least one cooling unit 230, a beer-dispensing pressurization and control system 280, and a plurality of casters 232 (e.g., swivel casters, fixed casters, etc., and/or combinations thereof). In some embodiments, the tank 204 and frame 212 may be similar, if not identical, to the tank 104 and frame 112, respectively, as described in conjunction with FIG. 1. Accordingly, any description of the structure, function, and/or the elements of the components of the beverage storage system 100 provided above may apply to the structure, function, and/or the elements of the components of the mobile beer-dispensing system 200.

The tank 204 may be a pressure vessel, or other container, configured to store beer therein. In some embodiments, the beer may be held inside a bag, or bladder, disposed inside the tank 204. The bladder may be fluidly interconnected with the fluid port 208 of the tank 204. In this example, the tank 204 may provide sufficient structure around the bladder to protect the bladder and beer during shipment, hold a positive or negative pressure, and/or thermally, or otherwise, insulate the beer inside the bladder from the environment outside of the tank 104.

In some embodiments, the tank 204 may be selectively pressurized to control a release of the beer from the bladder through the fluid port 208. For instance, a beer-dispensing pressurization and control system 280 may be configured to selectively control pressure applied to an interior of the tank 204. The beer-dispensing pressurization and control system 280 may comprise a compressor 260, a compressed-gas storage tank 265, a controlled valve system 270 (e.g., solenoid valve system, controller, etc.), a pressure regulation system 275, and one or more gas connections. In this case, when the dispensing tap is actuated, the controlled valve system 270 fluidly interconnects the gas stored in the compressed-gas storage tank 265 to the tank 204 via the pressure regulation system 275. The pressure regulation system 275 may control the pressure of the gas flowing into the tank 204, filter the gas, and/or otherwise condition the gas entering the tank 204. In some cases, the pressure regulation system 275 may be arranged before the controlled valve system 270, in the gas flow direction, such that the controlled valve system 270 is directly connected to the tank 204.

Once the gas enters the tank 204 from the beer-dispensing pressurization and control system 280, the space inside the tank 204 (e.g., the space between the inner walls of the tank 204 and the outside surface of the bladder contained therein) may be pressurized thereby exerting a pressure on the bladder and the beer inside the bladder. Once the handle of the tap 244 is actuated, the pressure inside the tank 204 forces the beer from the bladder through the port and valve 210 and along, or through, a fluid distribution line 240 until it is expelled, or dispensed, from the at least one dispensing tap 244. The fluid distribution line 240 may be insulated via a coating, covering, and/or other thermally insulated tubing. As the beer is dispensed, the pressure inside the tank 204 may at least partially collapse the bladder, until all of the beer is dispensed from the bladder. As provided above, the bladder disposed inside the tank may provide a clean, safe, and reliable storage of beer inside the tank 204. It should be appreciated, however, that embodiments of the present disclosure do not require a bladder to be disposed inside the tank 204 to operate. For instance, the beer may be stored directly inside the tank 204, and the tank 204 pressurized, to dispense beer therefrom.

The tank 204 may be mounted to a frame 212 for storage, transport, and/or protection. The tank 204 may be fastened to the frame 212 via one or more clamps, straps, and/or other supports. In some cases, the tank 204 may be mounted to the frame 212 via one or more isolation mounts. The isolation mounts may mechanically isolate the tank 204 from the frame 212. Mechanical isolation may include thermal and/or shock isolation. For example, any force or impact imparted on the frame 212 may be at least partially prevented from passing through to the tank 204. As another example, the tank 204 may be athermalized, or thermally isolated, from the frame 212 at the isolation mounts. In this example, the isolation mounts may include a thermal insulation layer or interruption in a thermal path between the tank 204 and the frame 212.

The frame 212 may comprise a metal, plastic, or composite shroud that is configured to protect the tank 204. In one embodiment, the frame 212 may be manufactured from welded metal (e.g., aluminum, steel, titanium, etc.) and comprise a base 216, a guard assembly 224, and a plurality of casters 232, or wheels. The base 216 may be made from welded structural tubing and include one or more lift points or receptacles 220. The lift receptacles 220 may be configured to receive one or more forks from a fork lift, such that the system 200 may be lifted, moved, and/or transported without contacting the tank 204. The guard assembly 224 may comprise one or more rails, crossbars, uprights, and/or frame elements that are interconnected to one another. In some embodiments, the guard assembly 224 may be welded, bent, and/or formed. The guard assembly 224 may be configured to extend beyond the bounds of, or envelope, the tank 204. The guard assembly 224 may provide a structural exoskeleton configured to prevent protect the tank 204 from incidental contact, damage, and/or other impact. In some cases, the guard assembly 224 may provide mount points for advertising, trademarks, messages, and/or other graphics. In one embodiment, the tank 204 may include one or more graphics (e.g., advertising, trademarks, messages, etc.) associated therewith. In any event, the graphics may be shown via at least one type of display element. Example display elements, displays, and graphics are described in conjunction with FIG. 4.

In some embodiments, the frame 212 may include a bumper 228, or other guard, disposed on one or more ends of the system 200. The bumper 228 may prevent the valve 210 and/or the fluid distribution line 240 from protruding past the frame 212. In some cases, the bumper 228 may be selectively pivoted, raised, or removed providing enhanced access to the port 208 of the tank 204 and/or interconnection thereto.

A drip tray 248, drain 250, and drain line 252 may be attached to the frame 212, and/or a portion thereof, under or adjacent to the dispensing tap 244. Among other things, the drain 250 and drain line 252 may be configured to direct excess beer, drips, or other fluids from the drip tray 248 to a point under the system 200 or into a wastewater drain or sewer.

The mobile beer-dispensing system 200 may include a cooling system comprising a cooling unit 230 and one or more cooling lines 236 configured to cool one or more of the tank 204, the at least one fluid distribution line 240, and/or the at least one dispensing tap 244. In one embodiment, the cooling unit 230 may be a glycol cooling system. Additionally or alternatively, the cooling unit 230 may include solid-state thermoelectric cooling technology components, or a system of components (e.g., a Peltier cooling system utilizing the Peltier effect to provide cooling of one or more cooled surfaces in the cooling unit 230, etc.). In any event, the cooling unit 230 may include at least one refrigerated cooling line 236 that passes from the cooling unit 230 to the tank 204 and back to the cooling unit 230. In some embodiments, the cooling line 236 may follow the at least one fluid distribution line 240 along a length of the distribution line 240. For example, the cooling line 236 may be wrapped around, follow along, and/or trace the at least one fluid distribution line 240, placed in direct contact with the at least one fluid distribution line 240, and/or disposed inside the at least one fluid distribution line 240. As described herein, tracing the at least one fluid distribution line 240 may include following the shape and/or curvature of the at least one fluid distribution line 240, in some cases, without helically wrapping around a complete periphery or diameter the line 240. In some embodiments, the cooling line 236 may exit from the cooling unit 230 via a port 234A, 234B to cool the tank 204, the fluid distribution lines 240, and/or dispensing taps 244 before the cooling line 236 returns to another port 234B, 234A of the cooling unit 230 forming a coolant loop. Examples of system 200 coolant loops, or cooling flows, are shown and described in conjunction with FIGS. 3A-3B.

The electrical components of the mobile beer-dispensing system 200 (e.g., controllers, solenoids, processors, compressor 260, cooling unit 230, etc.) may be powered via an on-board battery, solar array, photovoltaics, and/or an AC electrical interconnection. In some cases, the mobile beer-dispensing system 200 may include a transformer configured to convert AC electricity to DC electricity to power one or more of the components of the system 200.

Figure 3A:
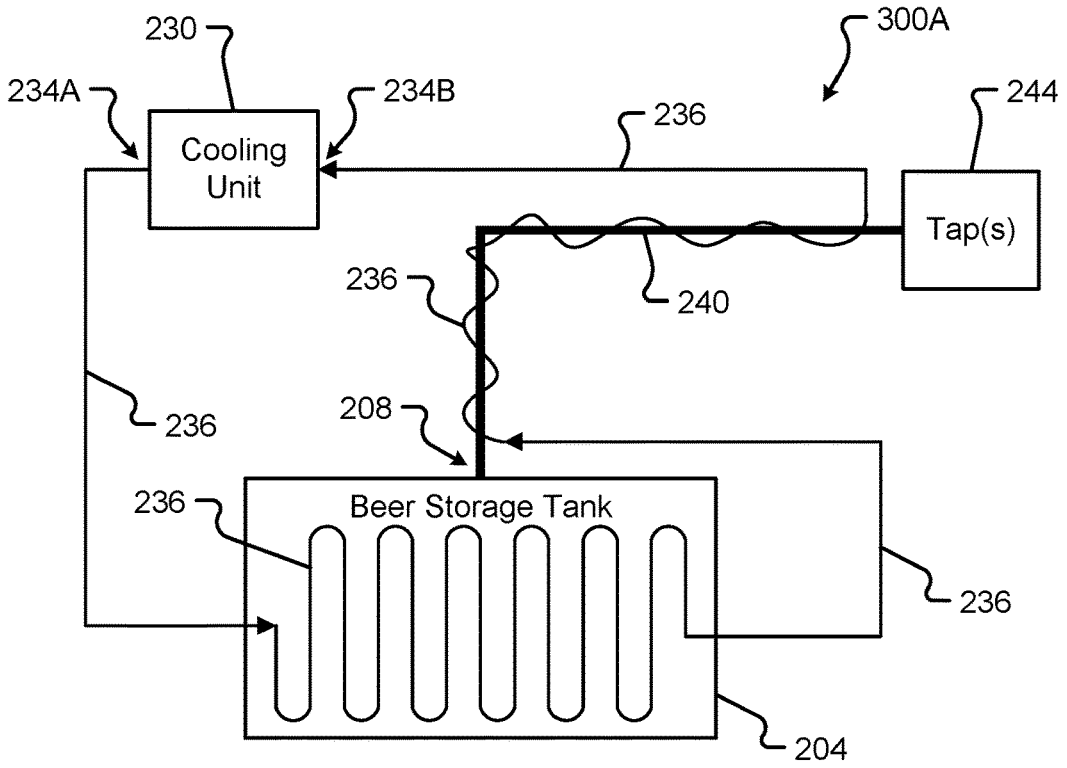
FIG. 3A shows a block diagram of a first cooling flow for a mobile beer-dispensing system in accordance with embodiments of the present disclosure.
Figure 3B:
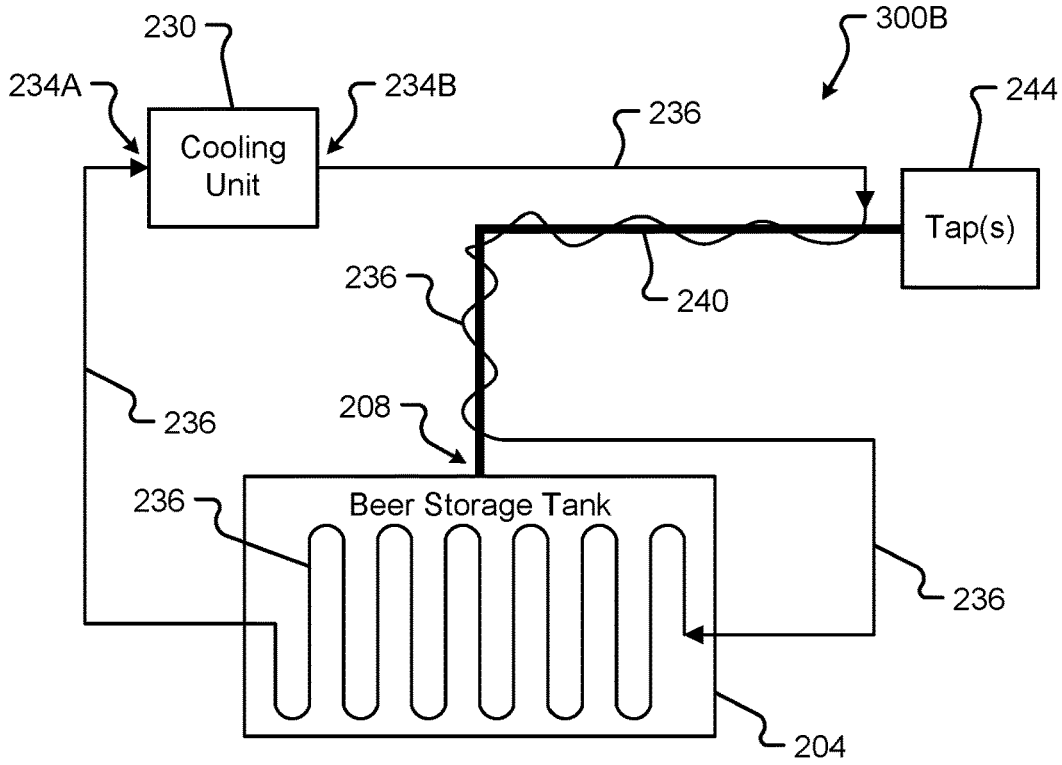
FIG. 3B shows a block diagram of a second cooling flow for a mobile beer-dispensing system in accordance with embodiments of the present disclosure.

FIGS. 3A-3B show block diagrams of various cooling flows 300A, 300B for the mobile beer-dispensing system 200 in accordance with embodiments of the present disclosure. The cooling flows of FIGS. 3A-3B are shown in a schematic block diagram where other components of the system 200 have been omitted for clarity. Each schematic block diagram shows the cooling unit 230 interconnected, via a coolant loop, to the beer storage tank 204 and the fluid distribution line 240 by a cooling line 236. The cooling line 236 may be metal, (e.g., copper, aluminum, stainless steel, steel, etc.) and/or composite tubing configured to convey and direct refrigerated fluid from an outlet of the cooling unit 230 to the tank 204, distribution lines 240, and/or the taps 244 and back to an inlet of the cooling unit 230. As the refrigerated fluid is cycled through the cooling unit 230 the fluid is re-cooled. Depending on the direction of the flow in the coolant loop, different components in the system 200 may be cooled before other components in the system 200.

Referring to FIG. 3A, a block diagram of a first cooling flow 300A for a mobile beer-dispensing system 200 is shown in accordance with embodiments of the present disclosure. In particular, the first cooling flow 300A shows coolant flowing from a first port 234A of the cooling unit 230 to the beer storage tank 204 via the cooling line 236. As shown in FIGS. 2-3B, the cooling line 236 may be wrapped around at least a portion of the tank 204. This arrangement of the cooling line 236 can provide even cooling of the tank 204 and provide greater surface-to-surface contact between the cooling line 236 and the tank 204 (e.g., providing more cooling surface area). Once the cooling line 236 passes the tank 204, the line 236 may follow the fluid distribution line 240 to the taps 244. In some embodiments, the cooling line 236 may engage with, and cool, at least a portion of the taps 244. In some embodiments, the cooling line 236 may follow the fluid distribution line 240 in direct contact with the line 240. In one embodiment, the cooling line 236 may be wrapped around, follow along, and/or trace at least a portion of the fluid distribution line 240 as the cooling line 236 follows the fluid distribution line 240. This arrangement of the cooling line 236 around the fluid distribution line 240 can provide even cooling of the fluid distribution line 240 and provide greater surface-to-surface contact between the cooling line 236 and the fluid distribution line 240. After following the fluid distribution line 240, the cooling line 236 returns to the cooling unit 230 at a second port 234B, where the refrigerated fluid is re-cooled by the cooling unit 230 before exiting the first port 234A (e.g., in a continuous cooling cycle).

FIG. 3B shows a block diagram of a second cooling flow 300B for a mobile beer-dispensing system 200 in accordance with embodiments of the present disclosure. The second cooling flow 300B shows coolant flowing from the second port 234B of the cooling unit 230 to the fluid distribution line 240, and/or the taps 244, via the cooling line 236. In some embodiments, the cooling line 236 may follow the fluid distribution line 240 in direct contact with the line 240. In one embodiment, the cooling line 236 may be wrapped around at least a portion of the fluid distribution line 240 as the cooling line 236 follows the fluid distribution line 240. This arrangement of the cooling line 236 around the fluid distribution line 240 can provide even cooling of the fluid distribution line 240 and provide greater surface-to-surface contact between the cooling line 236 and the fluid distribution line 240. In some embodiments, the cooling line 236 may engage with, and cool, at least a portion of the taps 244. After following the fluid distribution line 240, the cooling line 236 passes to tank 204. As described above, the cooling line 236 may be wrapped around at least a portion of the tank 204. This arrangement of the cooling line 236 can provide even cooling of the tank 204 and provide greater surface-to-surface contact between the cooling line 236 and the tank 204 (e.g., providing more cooling surface area). Once the cooling line 236 passes the tank 204, the line 236 may return to the cooling unit 230 at the first port 234A, where the refrigerated fluid is re-cooled by the cooling unit 230 before exiting the second port 234B (e.g., in a continuous cooling cycle).

Figure 4:
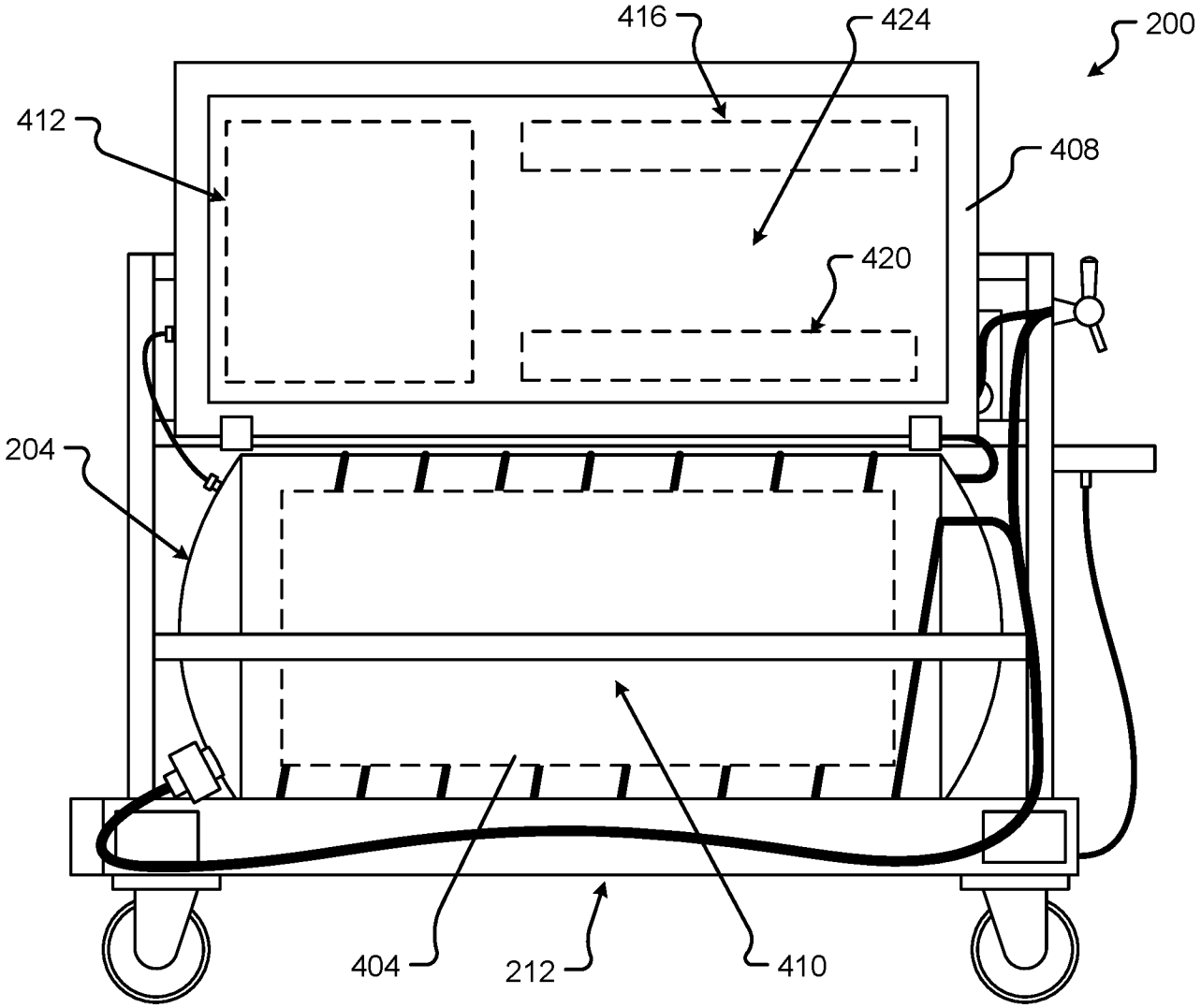
FIG. 4 shows a mobile beer-dispensing system including graphic elements in accordance with embodiments of the present disclosure.

FIG. 4 shows a mobile beer-dispensing system 200 including one or more graphic elements in accordance with embodiments of the present disclosure. As illustrated in FIG. 4, the mobile beer-dispensing system 200 may include one or more graphic display areas 404, 408 configured to present messages, trademarks, advertising, and/or other graphics. In one embodiment, the tank 204 of the mobile beer-dispensing system 200 may include at least one tank graphic display area 404. The tank graphic display area 404 may define a region of the tank 204 to which a tank graphic 410 may be attached. The tank graphic 410 may be one or more of a decal, adhesive-backed decoration, engraving, etching, painted image, printed image, photograph, inked image, or other mark, image, or object. In some embodiments, the tank graphic 410 may be etched in, attached to, or offset from the tank 204. As one example, the tank graphic 410 may include a company logo or other identification of the brewery providing the beer contained inside the tank 204.

In some embodiments, the frame 212 of the mobile beer-dispensing system 200 may include at least one system graphic display area 408. The system graphic display area 408 may be part of a display (e.g., LCD, CRT display, plasma display panel, LED display, electroluminescent display, electronic paper or e-ink display, television, monitor, etc.), a chalkboard, a framed graphic, and/or some other physical display device. In any event, the system graphic display area 408 may be configured to provide one or more messages, marks, or other graphics via at least one graphic portion 412-424. The graphic portions 412-424 may include, but are in no way limited to, decals, adhesive-backed decorations, engravings, etchings, painted images, printed images, photographs, inked images, illuminated pixels, or other marks, images, or objects. In some embodiments, the system graphic display area 408 may be connected to a portion of the mobile beer-dispensing system 200, such as the frame 212, via one or more mount points. In one embodiment, the system graphic display area 408 may be part of the mobile beer-dispensing system 200 (e.g., a structural component, etc.).

The system graphic display area 408 may include at least one graphic portion 412-424 configured to display a company logo, a trademark, a message, and/or an identification of the brewery providing the beer contained inside the tank 204. In one embodiment, the graphic display area 408 may be part of a chalkboard, whiteboard, or other writing surface. In one case, the chalkboard may include a first message area 412 providing an advertising message such as "Delivered fresh from the Golden Brewery," while the second, third, and fourth message areas 416, 420, 242 may provide further information about the freshness of the beer contained inside the tank 204. For example, the second message area 416 may provide the message "Filled On" and the third message area 420 may provide the words "Month Day Time." In this example, the fourth message area 424, disposed between the second and third message areas 416, 420, may be used to write or display the actual month, day, and even time the tank 204 was filled with beer. In the event that a chalkboard is used as the display, the information in the fourth message area 424 of the system graphic display area 408 may be handwritten in chalk. Among other things, this feature allows the chalkboard to be reused with the mobile beer-dispensing system 200.

Any of the steps, functions, and operations discussed herein can be performed continuously and automatically.

The exemplary systems and methods of this disclosure have been described in relation to beer-dispensing and cooling systems. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

Furthermore, while the exemplary embodiments illustrated herein show the various components of the system collocated, certain components of the system (e.g., controllers, etc.) can be located remotely, at distant portions of a distributed network, such as a LAN and/or the Internet, or within a dedicated system. Thus, it should be appreciated, that the components of the system can be combined into one or more devices, such as a server, communication device, or collocated on a particular node of a distributed network, such as an analog and/or digital telecommunications network, a packet-switched network, or a circuit-switched network. It will be appreciated from the preceding description, and for reasons of computational efficiency, that the components of the system can be arranged at any location within a distributed network of components without affecting the operation of the system.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire, and fiber optics, and may take the form of acoustic or light waves, such as those generated during radio-wave and infra-red data communications.

The processes disclosed herein been discussed and illustrated in relation to a particular sequence of events, however, it should be appreciated that changes, additions, and omissions to this sequence can occur without materially affecting the operation of the disclosed embodiments, configuration, and aspects.

A number of variations and modifications of the disclosure can be used. It would be possible to provide for some features of the disclosure without providing others.

In yet another embodiment, the systems and methods of this disclosure can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the present disclosure includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In yet another embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this disclosure is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as a program embedded on a personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the embodiments with reference to particular standards and protocols, the disclosure is not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various embodiments, configurations, and aspects, includes components, methods, processes, systems and/or apparatus substantially as depicted and described herein, including various embodiments, subcombinations, and subsets thereof. Those of skill in the art will understand how to make and use the systems and methods disclosed herein after understanding the present disclosure. The present disclosure, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and/or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

Embodiments include a mobile beer-dispensing system, comprising: a cart having a frame supported by two or more wheels; a fluid storage tank mechanically attached to the cart; a fluid dispensing tap connected to a portion of the cart; a fluid distribution line having a first end fluidly interconnected with the fluid storage tank and a second end fluidly interconnected with the fluid dispensing tap; and a cooling system comprising: a cooling unit including a refrigeration unit, a refrigerant, and a refrigerant pump; and at least one cooling line interconnected with the cooling unit and configured to direct the refrigerant along a coolant loop from the cooling unit to the fluid distribution line and/or the fluid storage tank and back to the cooling unit.

Aspects of the above mobile beer-dispensing system include wherein the fluid storage tank is configured to contain a bladder having a fluid. Aspects of the above mobile beer-dispensing system further comprising: a tank pressurization system, comprising: a compressor; a compressed-gas storage tank fluidly connected to the compressor; a solenoid valve fluidly connected to compressed-gas storage tank; and a pressure regulation system fluidly connected to the solenoid valve; wherein the tank pressurization system is configured to selectively provide pressure to the fluid storage tank and compress the bladder having the fluid. Aspects of the above mobile beer-dispensing system include wherein the coolant loop directs the refrigerant along a continuous cooling line in a direction from the cooling unit to the fluid distribution line and then to the fluid storage tank and then back to the cooling unit. Aspects of the above mobile beer-dispensing system include wherein the coolant loop directs the refrigerant along a continuous cooling line in a direction from the cooling unit to the fluid storage tank and then to the fluid distribution line and then back to the cooling unit. Aspects of the above mobile beer-dispensing system include wherein the fluid distribution line is fluidly interconnected with the fluid storage tank at a tank fluid port. Aspects of the above mobile beer-dispensing system include wherein the at least one cooling line comprises: a first cooling line fluidly interconnected to a first port of the cooling unit, wherein the first cooling line wraps around a periphery and follows along a length of the fluid storage tank; and a second cooling line fluidly interconnected to a second port of the cooling unit, wherein the second cooling line extends from the second port of the cooling unit to a first portion of the fluid distribution line disposed adjacent to the fluid dispensing tap and continues along a length of the fluid distribution line to a second portion of the fluid distribution line disposed adjacent to the tank fluid port, and wherein the first and second cooling lines are fluidly connected with one another defining a conveyance path for refrigerant in the coolant loop. Aspects of the above mobile beer-dispensing system include wherein the fluid storage tank is substantially cylindrical in shape, and wherein the first cooling line is spirally wound around the periphery of the substantially cylindrical fluid storage tank for at least a portion of the length of the fluid storage tank. Aspects of the above mobile beer-dispensing system include wherein the second cooling line is spirally wound around a periphery of the fluid distribution line for at least a portion of a length of the fluid distribution line. Aspects of the above mobile beer-dispensing system include wherein the first cooling line, after following the length of the fluid storage tank contacts the fluid distribution line at a first point and follows a length of the fluid distribution line from the first point to the second portion of the fluid distribution line disposed adjacent to the tank fluid port. Aspects of the above mobile beer-dispensing system include wherein the first cooling line is disposed in contact with a first portion of a side of the fluid distribution line at the first point and along the length of the fluid distribution line from the first point to the second portion of the fluid distribution line disposed adjacent to the tank fluid port, and wherein the second cooling line is disposed in contact with a second portion of the side of the fluid distribution line at the first point and along the length of the fluid distribution line from the first point to the second portion of the fluid distribution line disposed adjacent to the tank fluid port. Aspects of the above mobile beer-dispensing system include wherein an insulative material covers the first and second cooling lines from the first point to the second portion of the fluid distribution line disposed adjacent to the tank fluid port. Aspects of the above mobile beer-dispensing system include wherein the tank fluid port includes a valve disposed externally to the fluid storage tank, the valve controlling an output of fluid from the fluid storage tank. Aspects of the above mobile beer-dispensing system include wherein the frame includes a bumper disposed adjacent to the valve, and wherein the bumper covers at least a portion of the valve and/or the fluid distribution line disposed adjacent to the tank fluid port. Aspects of the above mobile beer-dispensing system include wherein the bumper is selectively moveable away from the valve and/or the fluid distribution line providing access to the tank fluid port of the fluid storage tank. Aspects of the above mobile beer-dispensing system further comprising: a graphic display area concealing at least a portion of the tank pressurization system and/or the cooling system, the graphic display area including discrete areas for at least one advertising message and a time that the fluid storage tank was filled with the fluid.

Embodiments include a mobile chilled beverage-dispensing system, comprising: a wheeled cart including a frame supported by at least two swivel casters mounted to a portion of the frame; a fluid storage tank disposed within a guard portion of the frame; a fluid dispensing tap connected to the cart; a fluid distribution line having a first end fluidly interconnected with the fluid storage tank and a second end fluidly interconnected with the fluid dispensing tap; and a cooling system comprising: a cooling unit including a refrigeration unit, a refrigerant, and a refrigerant pump; and at least one cooling line interconnected with the cooling unit and configured to convey the refrigerant across portions of the fluid storage tank and the fluid distribution line in a flow direction of a coolant loop, wherein the coolant loop follows a path between a connection of the at least one cooling line to a first port of the cooling unit at a first end of the at least one line and a connection of the at least one cooling line to a second port of the cooling unit at a second end of the at least one line.

Aspects of the above mobile chilled beverage-dispensing system include wherein the fluid storage tank contains a flexible bladder having a fluid. Aspects of the above mobile chilled beverage-dispensing system further comprising: a tank pressurization system disposed within the guard portion of the frame, the tank pressurization system comprising: a compressor; a compressed-gas storage tank fluidly connected to the compressor; a solenoid valve fluidly connected to compressed-gas storage tank; and a pressure regulation system fluidly connected to the solenoid valve; wherein the tank pressurization system is configured to selectively provide pressure to the fluid storage tank and compress the flexible bladder having the fluid.

Embodiments include a mobile beer-dispensing system, comprising: a cart having a frame supported by two or more wheels; a fluid storage tank mechanically attached to the cart and containing a flexible bladder having a fluid; a fluid dispensing tap connected to a portion of the cart; a fluid distribution line having a first end fluidly interconnected with the fluid storage tank and a second end fluidly interconnected with the fluid dispensing tap; a cooling system comprising: a cooling unit including a refrigeration unit, a refrigerant, and a refrigerant pump; and at least one cooling line interconnected with the cooling unit and configured to direct the refrigerant along a coolant loop from the cooling unit to the fluid distribution line and/or the fluid storage tank and back to the cooling unit; and a tank pressurization system disposed at least partially within a portion of the frame, the tank pressurization system comprising: a compressor; a compressed-gas storage tank fluidly connected to the compressor; a solenoid valve fluidly connected to compressed-gas storage tank; and a pressure regulation system fluidly connected to the solenoid valve; wherein the tank pressurization system is configured to selectively provide pressure to the fluid storage tank and compress the flexible bladder having the fluid.

Any one or more of the aspects/embodiments as substantially disclosed herein.

Any one or more of the aspects/embodiments as substantially disclosed herein optionally in combination with any one or more other aspects/embodiments as substantially disclosed herein.

One or more means adapted to perform any one or more of the above aspects/embodiments as substantially disclosed herein.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

Aspects of the present disclosure may take the form of an embodiment that is entirely hardware, an embodiment that is entirely software (including firmware, resident software, micro-code, etc.) or an embodiment combining software and hardware aspects that may all generally be referred to herein as a "circuit," "module," or "system." Any combination of one or more computer-readable medium(s) may be utilized. The computer-readable medium may be a computer-readable signal medium or a computer-readable storage medium.

The terms "determine," "calculate," "compute," and variations thereof, as used herein, are used interchangeably and include any type of methodology, process, mathematical operation or technique.

What is claimed is:

1. A mobile beer-dispensing system, comprising:

a cart comprising a frame supported by two or more wheels;

a fluid storage tank substantially cylindrical in shape and mechanically fastened to the frame of the cart;

a fluid dispensing tap connected to a portion of the cart;

a fluid distribution line having a first end fluidly interconnected with the fluid storage tank and a second end fluidly interconnected with the fluid dispensing tap; and a cooling system comprising:

a cooling unit including a refrigeration unit, a refrigerant, and a refrigerant pump; and a cooling line that is separate from the fluid distribution line, the cooling line interconnected with the cooling unit and configured to direct the refrigerant along a continuous coolant loop running from a first port of the cooling unit to a second port of the cooling unit, the continuous coolant loop comprising a first portion of the cooling line disposed along a length of the fluid distribution line and a second portion of the cooling line wrapped around a periphery and following along a length of the fluid storage tank, wherein the first portion of the cooling line runs from a point adjacent the first end of the fluid distribution line to a point adjacent the second end of the fluid distribution line.

2. The mobile beer-dispensing system of claim 1, wherein the fluid storage tank is configured to contain a bladder having a fluid.

3. The mobile beer-dispensing system of claim 2, further comprising:

a tank pressurization system, comprising:

a compressor;

a compressed-gas storage tank fluidly connected to the compressor;

a solenoid valve fluidly connected to the compressed-gas storage tank; and a pressure regulator that controls a pressure of a gas flowing from the compressed-gas storage tank as the gas flows through the pressure regulator, wherein the pressure regulator is fluidly connected to the solenoid valve;

wherein the tank pressurization system is configured to selectively pressurize the fluid storage tank and compress the bladder having the fluid via the gas flowing from the compressed-gas storage tank through the pressure regulator.

4. The mobile beer-dispensing system of claim 3, wherein the refrigerant is directed by the cooling unit along the continuous coolant loop in a direction from the cooling unit to the fluid distribution line and then from the fluid storage tank to the fluid storage tank and then from the fluid storage tank back to the cooling unit.

5. The mobile beer-dispensing system of claim 3, wherein the refrigerant is directed by the cooling unit along the continuous coolant loop in a direction from the cooling unit to the fluid storage tank and then from the fluid storage tank to the fluid distribution line and then from the fluid distribution line back to the cooling unit.

6. The mobile beer-dispensing system of claim 3, wherein the fluid distribution line is fluidly interconnected with the fluid storage tank at a tank fluid port.

7. The mobile beer-dispensing system of claim 6, wherein the first cooling line is spirally wound around the periphery of the substantially cylindrical fluid storage tank for at least a portion of the length of the fluid storage tank.

8. The mobile beer-dispensing system of claim 7, wherein the first portion of the cooling line is spirally wound around a periphery of the fluid distribution line for at least a portion of the length of the fluid distribution line.

9. The mobile beer-dispensing system of claim 7, wherein the cooling line directly contacts the fluid distribution line at the point adjacent the first end of the fluid distribution line and at the point adjacent the second end of the fluid distribution line.

10. The mobile beer-dispensing system of claim 9, wherein the second portion of the cooling line, after following along the length of the fluid storage tank, runs from an end of the fluid storage tank back along a portion of the length of the fluid storage tank to a point at the tank fluid port and joins with the first of the fluid distribution line.

11. The mobile beer-dispensing system of claim 10, wherein the cooling line is insulated from the end of the fluid storage tank to the point adjacent the second end of the fluid distribution line.

12. The mobile beer-dispensing system of claim 6, wherein the tank fluid port includes a valve disposed externally to the fluid storage tank, the valve controlling an output of fluid from the fluid storage tank.

13. The mobile beer-dispensing system of claim 12, wherein the frame includes a bumper disposed adjacent to the valve, and wherein the bumper covers at least a portion of the valve and the fluid distribution line disposed adjacent to the point at the tank fluid port.

14. The mobile beer-dispensing system of claim 13, wherein the bumper is selectively moveable away from the valve providing access to the tank fluid port of the fluid storage tank.

15. The mobile beer-dispensing system of claim 14, further comprising:

a graphic display area concealing at least a portion of the tank pressurization system and the cooling system, the graphic display area including discrete areas for an advertising message and a time comprising a month and a day that the fluid storage tank was filled with the fluid.

16. A mobile chilled beverage-dispensing system, comprising:

a wheeled cart including a frame supported by at least two swivel casters mounted to a portion of the frame;

a fluid storage tank comprising a substantially cylindrical body running from a first end to a second end, the fluid storage tank fastened to the frame and disposed within a guard portion of the frame;

a fluid dispensing tap connected to the cart;

a fluid distribution line having a first connection end fluidly interconnected with the fluid storage tank and a second connection end fluidly interconnected with the fluid dispensing tap; and a cooling system comprising:

a cooling unit including a refrigeration unit, a refrigerant, and a refrigerant pump; and a cooling line that is separate from the fluid distribution line, the cooling line interconnected with the cooling unit and configured to convey the refrigerant across portions of the fluid storage tank and the fluid distribution line in a flow direction of a continuous coolant loop, wherein the continuous coolant loop follows a path between a connection of the cooling line to a first port of the cooling unit at a first line end of the cooling line and a connection of the cooling line to a second port of the cooling unit at a second line end of the cooling line, wherein the cooling line in the continuous coolant loop wraps around a end and, after following the length of the fluid storage tank, runs from the first end of the fluid storage tank back along a portion of the length of the fluid storage tank in a direction toward the second end of the fluid storage tank to a point adjacent the first connection end of the fluid distribution line and continues to run along the fluid distribution line from the first connection end to the second connection end.

17. The mobile chilled beverage-dispensing system of claim 16, wherein the fluid storage tank contains a flexible bladder having a fluid.

18. The mobile chilled beverage-dispensing system of claim 17, further comprising:

a tank pressurization system disposed within the guard portion of the frame, the tank pressurization system comprising:

a compressor;

a compressed-gas storage tank fluidly connected to the compressor;

a solenoid valve fluidly connected to the compressed-gas storage tank; and a pressure regulator that controls a pressure of a gas flowing from the compressed-gas storage tank as the gas flows through the pressure regulator, wherein the pressure regulator is fluidly connected to the solenoid valve;

wherein the tank pressurization system is configured to selectively pressurize the fluid storage tank and compress the flexible bladder having the fluid via the gas flowing from the compressed-gas storage tank through the pressure regulator.

19. A mobile beer-dispensing system, comprising:

a cart comprising a frame supported by two or more wheels attached to a base, of the frame;

a fluid storage tank mechanically fastened to the frame of the cart and containing a flexible bladder having a fluid, the flexible bladder disposed entirely within a substantially cylindrical body of the fluid storage tank;

a fluid dispensing tap connected to a portion of the cart;

a fluid distribution line having a first end fluidly interconnected with the fluid storage tank and a second end fluidly interconnected with the fluid dispensing tap;

a cooling system comprising:

a cooling unit including a refrigeration unit, a refrigerant, and a refrigerant pump; and a cooling line interconnected with the cooling unit and configured to direct the refrigerant along a continuous coolant loop running from a first port of the cooling unit to a second port of the cooling unit, the continuous coolant loop comprising a first portion of the cooling line disposed along a length of the fluid distribution line and a second portion of the cooling line wrapped around a periphery and following along a length of the fluid storage tank, wherein the first portion of the cooling line runs from a point adjacent the first end of the fluid distribution line to a point adjacent the second end of the fluid distribution line; and a tank pressurization system disposed at least partially within a portion of the frame, the tank pressurization system comprising:

a compressor;

a compressed-gas storage tank fluidly connected to the compressor;

a solenoid valve fluidly connected to compressed-gas storage tank; and a pressure regulator that controls a pressure of a gas flowing from the compressed-gas storage tank as the gas flows through the pressure regulator, wherein the pressure regulator is fluidly connected to the solenoid valve;

wherein the tank pressurization system is configured to selectively pressurize the fluid storage tank and compress the flexible bladder having the fluid via the gas flowing from the compressed-gas storage tank through the pressure regulator.

20. The mobile beer-dispensing system of claim 19, wherein the fluid storage tank is oriented horizontally in the frame such that an axis of substantially cylindrical body is arranged parallel to the base of the frame, wherein the fluid storage tank is disposed in a lower portion of the frame closest to the base of the frame, and wherein the cooling unit and the tank pressurization system are disposed above the substantially cylindrical body of the fluid storage tank in an upper portion of the frame.

* * * * *